US005255823A

United States Patent [19]

Tichy et al.

[11] Patent Number: 5,255,823

[45] Date of Patent: Oct. 26, 1993

[54] ACTUATOR AND CAP FOR A FLUID DISPENSER

[75] Inventors: Edward Tichy, Trumbull; Craig R. Bures, Prospect; Brooks Markert, Harwinton; Lance A. Monje, Orange; Stephen P. McNamara, Fairfield, all of Conn.

[73] Assignee: Risdon Corporation, Naugatuck, Conn.

[21] Appl. No.: 886,765

[22] Filed: May 21, 1992

[51] Int. Cl.[5] ..... B67D 5/00

[52] U.S. Cl. ..... 222/153; 222/182; 222/321; 222/402.11; 222/402.13; 222/522

[58] Field of Search ..... 222/153, 182, 321, 402.13, 222/519-525, 402.11, 402.12, 385

[56] References Cited

U.S. PATENT DOCUMENTS

| | | | |
|---|---|---|---|
| 1,796,785 | 3/1931 | Harding, Jr. | 222/522 |
| 2,700,484 | 1/1955 | Rathsprecher | 222/519 X |
| 2,980,302 | 4/1961 | Rasmussen | 222/525 X |
| 3,120,909 | 2/1964 | Miller | 222/522 |
| 3,249,260 | 5/1966 | Goldberg | 222/519 X |
| 3,263,869 | 8/1966 | Corsette | 222/182 |
| 3,266,680 | 8/1966 | Newman | 222/519 |
| 3,674,184 | 7/1972 | Ewald | 222/182 X |
| 3,782,605 | 1/1974 | Messenger | 222/402.11 X |
| 3,844,448 | 10/1974 | Sette | 222/402.11 X |
| 4,018,365 | 4/1977 | Butcher | 222/402.11 X |
| 4,344,744 | 8/1982 | Schuster et al. | 222/321 X |
| 4,383,623 | 5/1983 | Page, III | 222/521 |
| 4,817,831 | 4/1989 | Theisen | 222/499 |
| 4,991,747 | 2/1991 | Van Brocklin | 222/321 |
| 5,004,127 | 4/1991 | Morel | 222/521 |
| 5,083,682 | 1/1992 | Cater | 222/321 |

*Primary Examiner*—Andres Kashnikow
*Assistant Examiner*—Anthoula Pomrening
*Attorney, Agent, or Firm*—St. Onge Steward Johnston & Reens

[57] ABSTRACT

An actuator having an actuator body and a cap that can be raised or retracted is disclosed. The cap has an aperture sized to fit around the body. In the raised position, the actuator fits into the aperture and the body upper end is shaped to conform with the upper surface of the cap. This encloses the nozzle and provides a smooth upper surface when the cap is raised. When the cap is retracted, the body extends upwardly through the aperture so that it may be pushed on to dispense a liquid from the container on which the actuator is mounted.

18 Claims, 6 Drawing Sheets

ACTUATOR AND CAP FOR A FLUID DISPENSER

BACKGROUND OF THE INVENTION

1. Field of the Invention

The present invention relates to manually operated actuators and caps for reciprocating pumps for dispensing viscous lotions and other liquids from a container.

2. Background of the Invention

A conventional pump for dispensing liquids from a container includes an actuator having a nozzle from which the liquid is dispensed and which is used to actuate the pump mechanism. The design of the actuator will vary depending on the liquid to be dispensed. Lotions and other viscous liquids will have an actuator which has a vertically extending stem and a laterally extending nozzle. Fragrances and other liquids will have an actuator which is a short stubby cylinder with a nozzle which is flush with the actuator cylinder.

The pump to which the actuator is affixed typically includes a hollow body having openings in each end. A hollow piston which is slidable reciprocally in the body with sealing fit is fitted into the upper end of the body. Upper and lower valves are provided in the upper and lower ends of the body and are typically ball valves as disclosed in U.S. Pat. No. 3,963,150, or they may have other shapes, such as a planar valve element as disclosed in U.S. Pat. No. 3,991,914. Such valves are typically dependent on liquid pressure causing the ball to move away from the valve seat.

The piston is typically connected at its upper end to the actuator. The piston is operably connected to the actuator so that liquid pumped from the container is dispensed through the actuator.

An overcap is frequently provided to cover the actuator. The overcap is generally a separate cap that seats onto the container onto which the pump is affixed. An overcap is typically used when there is a stubby actuator and nozzle, but is not typically used with a lotion pump actuator with a laterally extending stem. This is due to the length of the laterally extending stem which may extend beyond an envelope defined by the overcap.

It would be desirable to provide a pump actuator suitable for dispensing a lotion and which also provides an overcap to cover the dispensing end of the actuator. It would be desirable to provide such a pump actuator that integrally includes such a cap so that it cannot be separated from the actuator and lost. These problems are addressed and resolved by the present invention as set forth hereafter.

SUMMARY OF THE INVENTION

It is an object of the invention to provide a lotion pump actuator that can be covered by an integral cap. It is an object of the invention to provide a cap that is retained by the container and dispenser pump so as not to be lost. It is an object of the invention to provide a cap that can remove unwanted residue from the nozzle of the actuator.

These objects, and other objects which will become apparent from the description that follows, are achieved by a pump actuator generally comprising an actuator body having a channel extending therethrough to a nozzle end on one side of the actuator body; and a cap having an aperture sized to snugly receive the actuator body. The cap is slidingly retained on the container. The cap is movable from a raised position to a retracted position. In the raised position the actuator body fits into the aperture in the cap to enclose the nozzle and provide the cap with a substantially flush upper surface. In the retracted position the cap is located such that the actuator body extends upwardly from the cap without obstruction of the nozzle end. Means for locking the cap in the raised position and in the retracted position are provided. In one preferred embodiment, the container comprises a larger diameter lower segment and a smaller diameter upper segment which is sized to telescopically fit inside the cap and retain the cap to the container. The cap is provided with a lower cap skirt which is slidable around the container. A reciprocating pump is preferably connected to the actuator, such that the actuator channel is operably connected to the pump. Most preferably, the actuator body is substantially planar and the aperture in the cap is a rectangular slot.

Other objects, aspects and features of the present invention in addition to those mentioned above will be pointed out in detail or will be understood from the following detailed description provided in conjunction with the accompanying drawings.

DESCRIPTION OF THE PREFERRED EMBODIMENT

Figure 2:
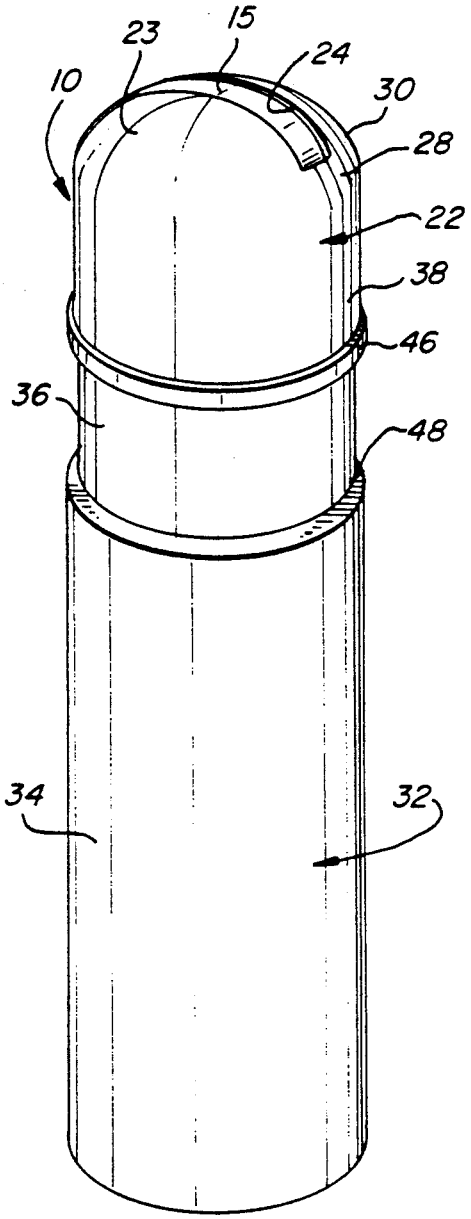
FIG. 2 is an elevation view of the pump actuator of FIG. 1 with its cap in a retracted position exposing the actuator.
Figure 1:
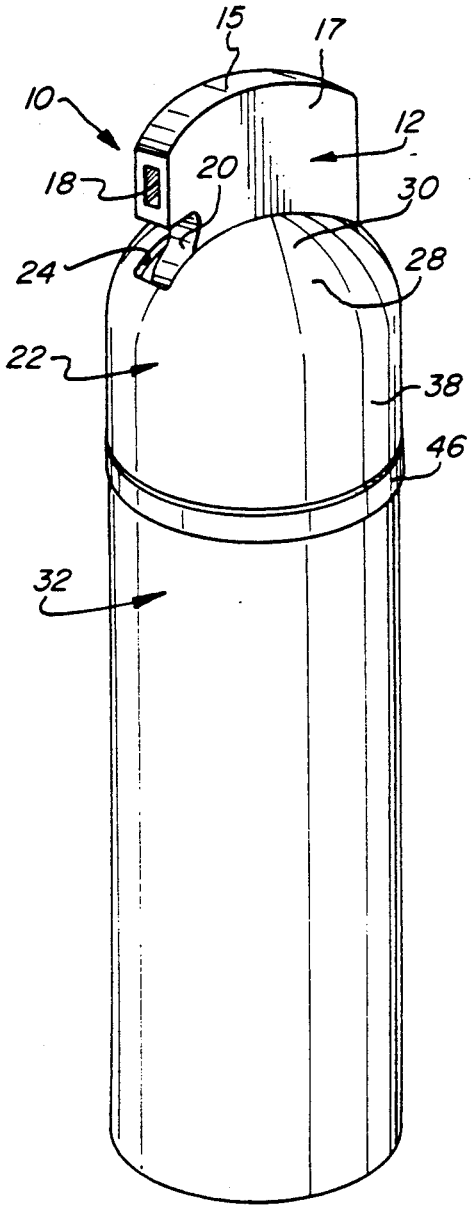
FIG. 1 is an elevation view of an embodiment of a pump actuator of the present invention with its cap in a raised position covering the actuator.
Figure 3:
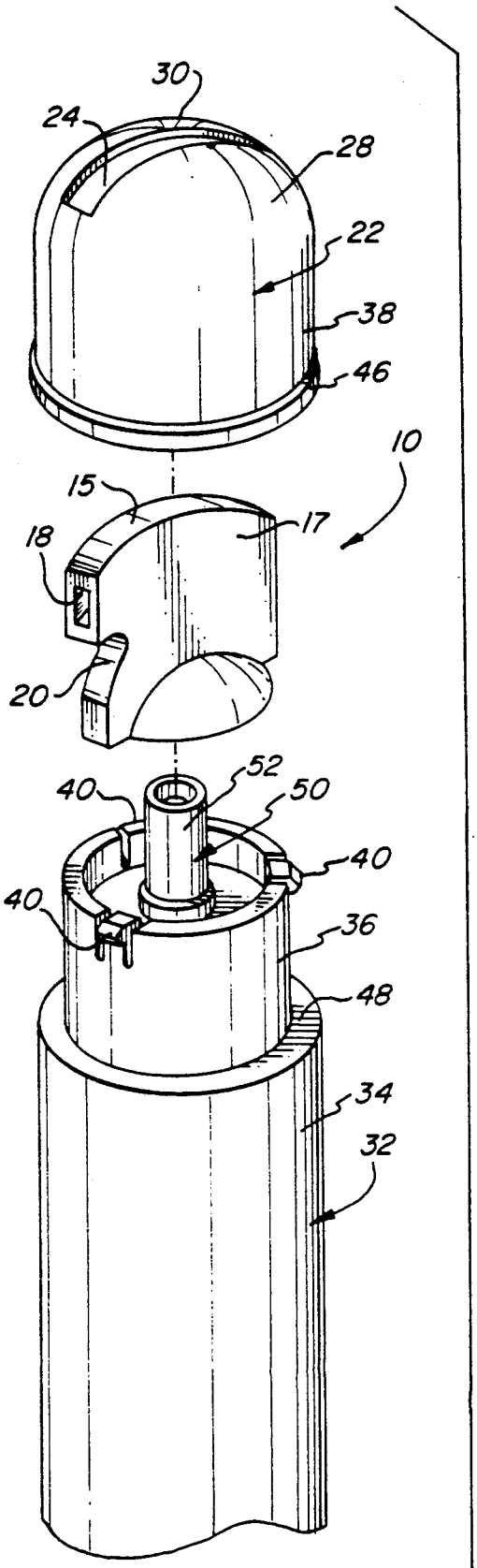
FIG. 3 is an exploded perspective view of an embodiment of the pump actuator of the invention.

With reference to FIGS. 1–6, where like numbers indicate like elements in the Figures, a pump actuator 10 is shown. Pump actuator 10 has an actuator body 12 and a cap 22 and is mounted on a pump 50. Actuator body 12 has a channel 14 extending therethrough from a pump end 16 to a nozzle end 18. Pump end 16 is typically located at the lower end of actuator body 12, and the nozzle end 18 is preferably located along one lateral side of actuator body 12. Actuator body 12 is preferably a substantially planar body, as seen in FIGS. 1 and 3. A planar body is desirable as it gives a substantial actuation surface on its upper surface 15 of its upper end 17. However, a round body may be used instead if desired. Most preferably, nozzle end 18 is located along the more narrow side of the slab-like, planar actuator body shown. A notched cutaway 20 is preferably included below nozzle end 18 of the planar actuator body 12 so that the nozzle end 18 is visibly distinct from the planar body 12. This makes the body 12 easier to orient and makes it easier to understand in which direction the nozzle end 18 is pointed.

Figure 4:
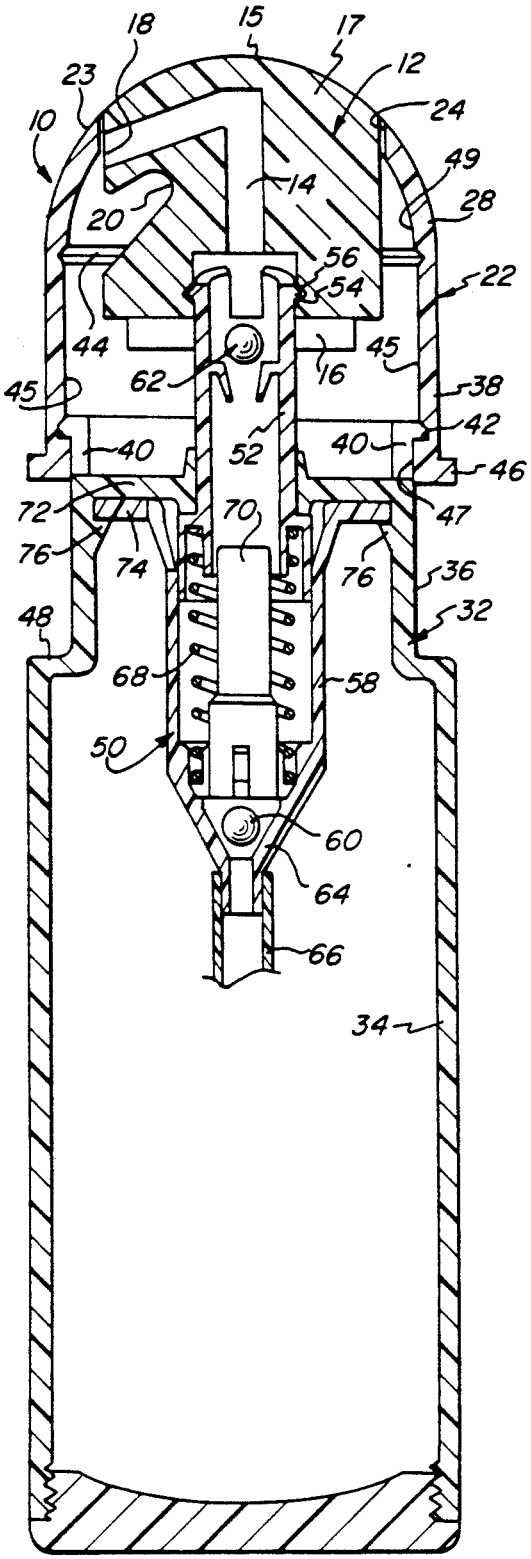
FIG. 4 is a cross-sectional view of an embodiment of a pump actuator of the present invention with its cap in a raised position covering the actuator.
Figure 5:
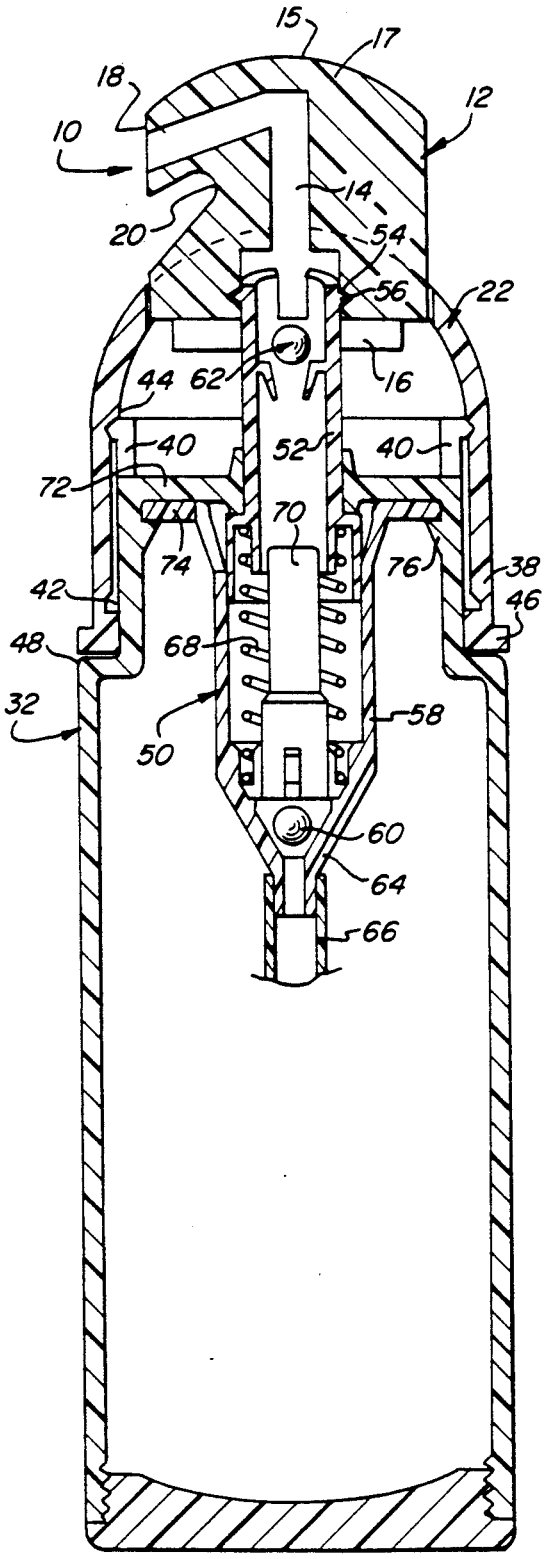
FIG. 5 is a cross-sectional view of the pump actuator of FIG. 4 with its cap in a retracted position exposing the actuator.
Figure 8:
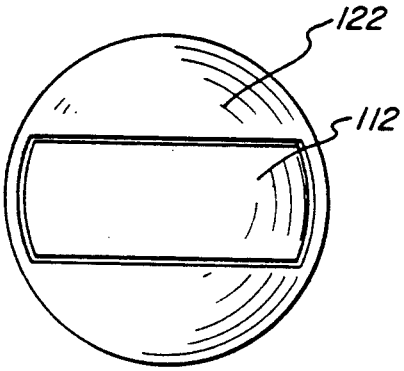
FIG. 8 is a top plan view of the actuator of FIG. 7.

Cap 22 is provided with aperture 24 sized to snugly receive the actuator body 12. A snug fit is desired to permit the edges of the aperture 24 to scrape off any excess liquid from the nozzle end 18. In addition, a snug fit provides a desired substantially flush upper surface when the cap is in the raised position. Preferably, aperture 24 is a rectangular slot to receive the substantially planar actuator body 12 of the preferred embodiment. Cap 22 is slidingly retained on the container 32. Cap 22 is movable on container 32 between a raised position as shown in FIGS. 1 and 5 and a retracted position as shown in FIGS. 2 and 4.

When cap 22 is in the raised position the actuator body 12 fits into the aperture 24 in the cap 22 to enclose the nozzle end 18 and to provide a substantially flush upper surface 23. In the preferred embodiment, the cap 22 has an upper segment 28 having a curved upper surface 30 that is congruent with a curved upper surface 15 of the upper end 17 of the planar actuator body 12. This provides the pump actuator 10 with a sleek and tidy appearance when it is stored or not in use.

When cap 22 is in the retracted position it is located such that the actuator body 12 extends upwardly through aperture 24 in cap 22. When the cap 22 is in the retracted position, the actuator body 12 is accessible without obstruction of the nozzle end 18. The user may then push on the upper surface 15 of the actuator body 12 to operate pump 50 to dispense a liquid from the container 32 on which actuator 10 is mounted.

In one preferred embodiment, the container 32 comprises a larger diameter lower segment 34 and a smaller diameter upper segment 36 which is sized to telescopically fit inside the cap 22 and retain the cap 22 to the container 32. In particular, the cap 22 is provided with a lower cap skirt 38 which is slidable on the container 32.

Figure 6:
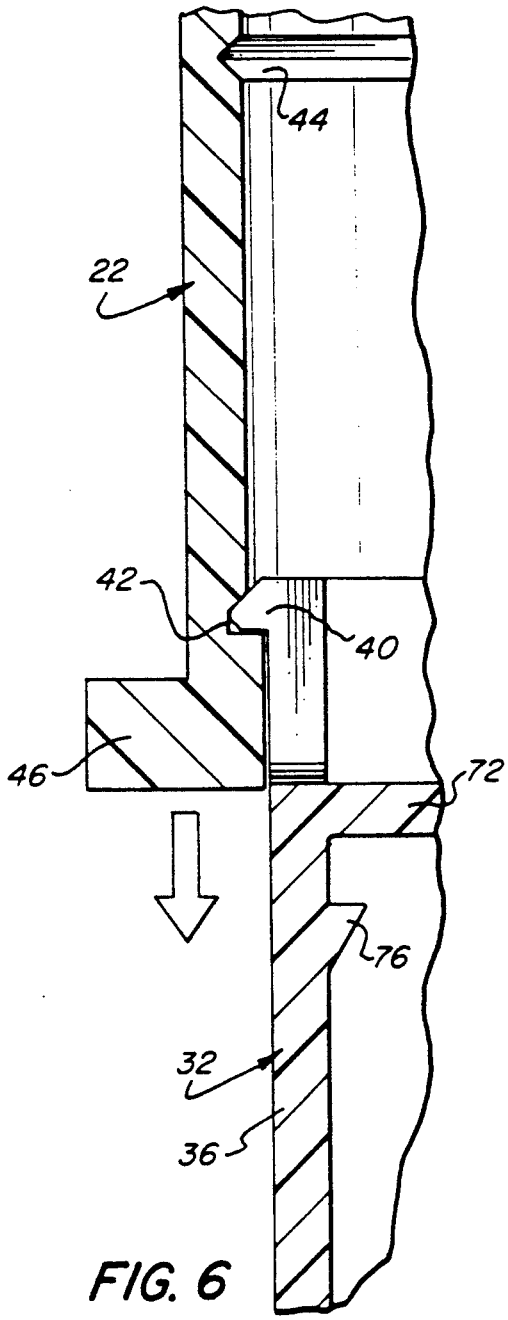
FIG. 6 is a detail cross-sectional view of the pump actuator of FIG. 4 showing the cap in its raised position.

Means for locking the cap in the raised position and in the retracted position are provided. In one preferred embodiment, the locking means comprise a plurality of resilient locking tabs 40 extending radially outwardly from the upper end of container upper segment 36. Locking tabs 40 are preferably cutaway along their sides from the container upper segment to give resilience. Locking tabs 40 are preferably sharp edged to retain the cap 22 by snap fitting into annular channels 42 and 44 around the inner diameter of cap 22. As can be seen in FIGS. 4–6, annular channel 42 is located in the lower portion of cap 22 while annular channel 44 is located in the upper middle portion of cap 22. The interengagement of locking tabs 40 with annular channel 42 locks the cap 22 in its raised position. The cap may be manually moved downwardly until the tabs 40 engage the annular channel 44 to lock cap 22 in its retracted position. A thin wall area 45 is provided in cap 22 between the channels 42 and 44 so that the cap 22 may be more easily moved from the raised position to the retracted position by simple pulling and pushing on the cap. The thin wall area permits the locking tabs 40 to more easily disengage when movement between the raised and retracted positions is desired. Thick wall areas 47 and 49 are provided above and below the thin wall area 45 that have wall thicknesses that extend inwardly to a greater distance than the thin wall area 45. The thick wall areas 47 and 49 prevent unintended disengagement of the locking tabs 40 that could cause the cap 22 to be removed from body 32. It is to be appreciated that the locking tabs could be modified within the scope of the invention, and might include an annular radially extending ring, or more rigid tab elements, and that the mating channels could also be modified.

A lip 46 is preferably provided at the lower edge of cap 22 to abut the shoulder 48 of container 32 when the cap 22 is in the retracted position.

A reciprocating pump 50 is preferably connected to the actuator 10, such that the actuator channel 14 is operably connected to the pump 50. In particular, actuator body 12 is mounted to the upper end of a piston 52, either by interengagement of a rib 54 and a groove 56, or by screw mating surfaces, or by gluing or other securing means.

Pump 50 comprises a hollow body 58, a lower valve 60, a piston 52, and an upper valve 62. Hollow body 58 has an upper opening in its upper end and a lower opening in its lower end. Hollow body 58 is generally cylindrical in shape and circular in cross-section. The upper opening is substantially the same size as the cross-section of the hollow chamber within the body 58 so that the piston 52 can be inserted therethrough. The lower opening is preferably provided in a short tubular extension 64 which extends downwardly from the body 58. The tubular extension is provided so that a diptube 66 may be mounted thereon to extend down into the container 32 onto which the pump 50 is to be mounted.

Lower valve 60 is located in and adapted to close the lower opening in the lower end of body 58 when there is an increase in pressure inside hollow body 58. Valve 60 is operable to open the lower opening during a decrease in pressure inside the hollow body 58.

Piston 52 is fitted into the upper end of body 58. Piston 52 is slidable reciprocally with sealing fit in body 58. Piston 52 has an upper opening in its upper end and a lower opening in its lower end. Piston 52 has upper valve 62 located in its upper end. Upper valve 62 is movable to vent the body 58 during an increase in pressure inside the body 58 and to close the body 58 during a decrease in pressure inside the hollow body 58. A piston spring 68 is installed to bias the piston 52 against a downward stroke and to bias the piston 52 with an upward stroke. A lower end of the spring retains the lower end of a pump core 70 to retain the core 70 in the body 58.

Pump 50 is retained inside container 32 by a collar 72 formed with container 32 for retaining piston 52 in pump body 58. Body 58 has a collar 74 which is retained against the container collar 72 by a plurality of retaining protruberances 76 formed in the inner walls of container 32. Alternatively, body collar 74 may be retained by a groove formed in the inner diameter of container 32.

The cap 22 and container 32 are preferably made of plastic or metal, preferably the same material, to provide a uniform decorative appearance, although other materials may be used for a different decorative effect. The pump 50 and its components are preferably formed of a plastic material such as polypropylene. The actuator body 12 is preferably also formed of a plastic material such as polypropylene.

The operation of the invention is shown generally by the drawings. Referring to FIGS. 2 and 4, cap 22 is shown in the raised position. The consumer who desires to dispense a liquid from the container 32 may simply grasp the cap 22 and push it downwardly to release the locking tabs 40 from the channel 42 until the lip 46 of cap 22 is stopped by the shoulder 48 of container 32. At this point the locking tabs 40 are seated in the channel 44 and the actuator body 12 is extending upwardly through the cap 22. The consumer can then press on the upper surface 15 to activate the pump 50 to draw liquid from the container and dispense it through nozzle end 18. When the consumer is finished, she may lift up on cap 22, causing the locking tabs 40 to release from channel 44 until the locking tabs 40 engage the channel 42 so that cap 22 is again in the raised position as shown in FIGS. 1 and 5.

The benefits of the retractable cap may also be obtained by an alternative embodiment of the invention in which the cap comprises an upper cap segment and a lower cap skirt which has a lesser diameter than the upper cap segment. The lower cap skirt fits slidably into and is retained in a channel in the upper end of the container. The channel is provided between an outer wall and an inner wall of the upper end of the container. The outer wall and the inner wall may be integrally joined together in a molding process, or the outer wall and the inner wall may comprise separate nesting vessels each having a wall and a base portion, and which are secured together in their base portions. In this alternative embodiment, the means for locking the cap in its raised position may comprise a spring resilient locking tab element extending radially outwardly from the lower cap skirt sufficiently to engage the upper lip of the outer wall of the container to lock the cap in a raised position. The locking tab element is sufficiently resilient to be displaceable radially inwardly to disengage the container to release the cap to move the cap to a retracted position.

Figure 7:
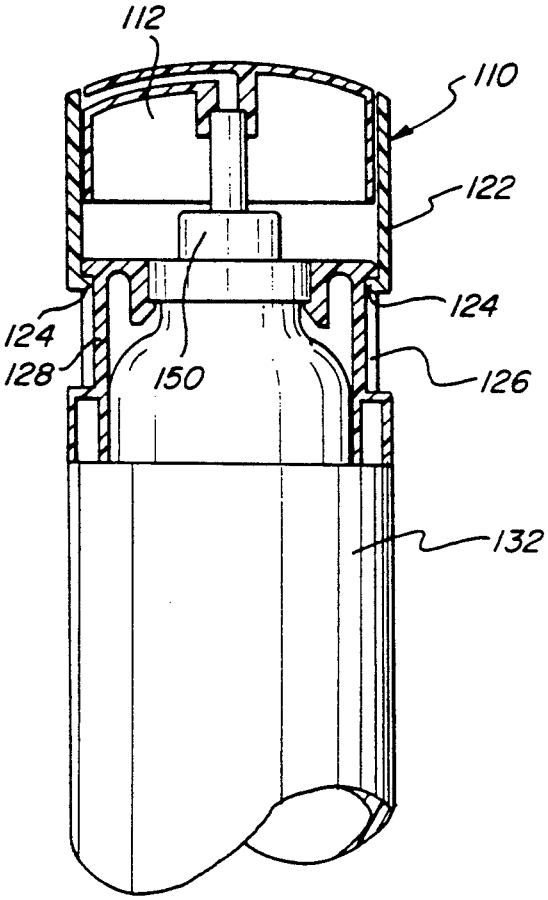
FIG. 7 is a cross-sectional view of another embodiment of an actuator of the present invention with its cap in a raised position covering the actuator.
Figure 9:
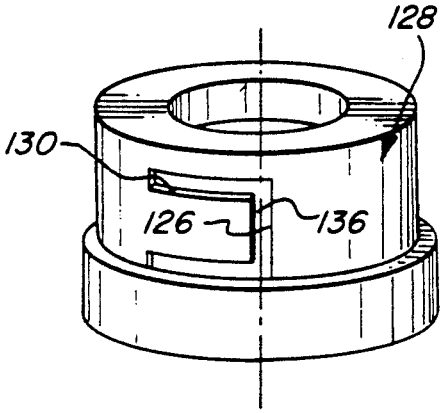
FIG. 9 is a perspective view of an upper collar segment of the actuator of FIG. 7.
Figure 10:
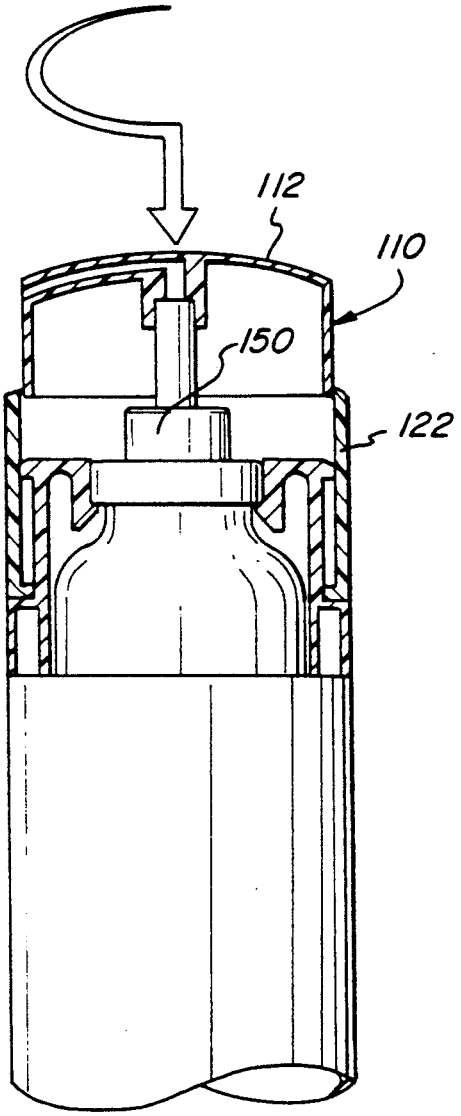
FIG. 10 is a cross-sectional view of the actuator of FIG. 7 with its cap in a retracted position exposing the actuator.
Figure 11:
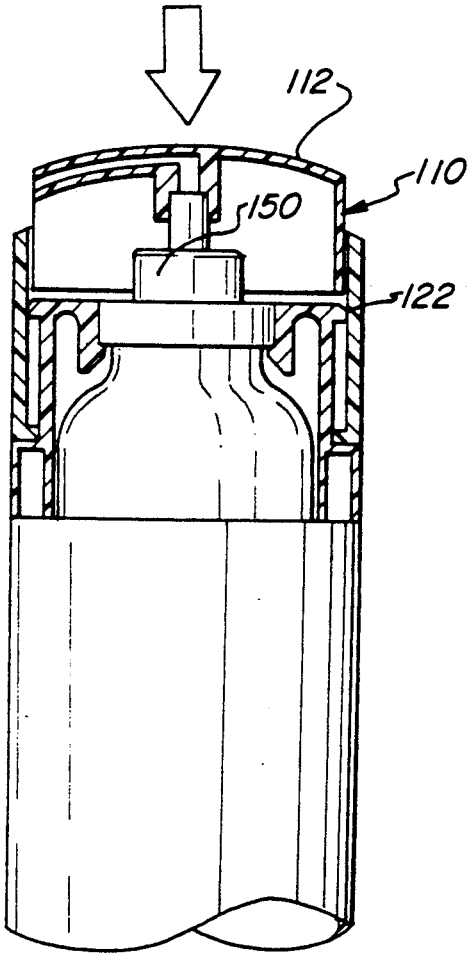
FIG. 11 is a cross-sectional view of the actuator of FIG. 10 with its cap in a retracted position and the actuator depressed.

With reference to FIGS. 7–11, where like numbers indicate like elements in the Figures, another embodiment of an actuator 110 is shown. Actuator 110 has an actuator body 112 and a cap 122 and is mounted on a container 132. Actuator body 112 may be substantially as described in reference to actuator body 12 of the pump actuator 10. Cap 122 is movable on container 132 between a raised position as shown in FIG. 7 and a retracted position as shown in FIGS. 10 and 11 by rotation of the cap 122 and pushing the cap downward. This is due to the engagement of tracking pins 124 in tracks 126 in the upper collar segment 128. Upper collar segment 128 is preferably a separate piece mounted by crimping or snapping onto a container 132 or it can be integrally formed therewith. The tracks 126 include a vertical track segment 136 and at least one horizontal track segment 130 on the upper end of the vertical track segment 136 and preferably there is a second horizontal track segment 134 on the lower end of the vertical track segment 136. The horizontal track segments permit locking of the cap 122 in the raised position and in the retracted position. The embodiment of the actuator 110 is operable to be uncovered by rotating the cap 122 and pushing it downward. The cap is raised by pulling it upwardly and rotating the cap so that the tracking pins lock in the upper horizontal channel.

Figure 12:
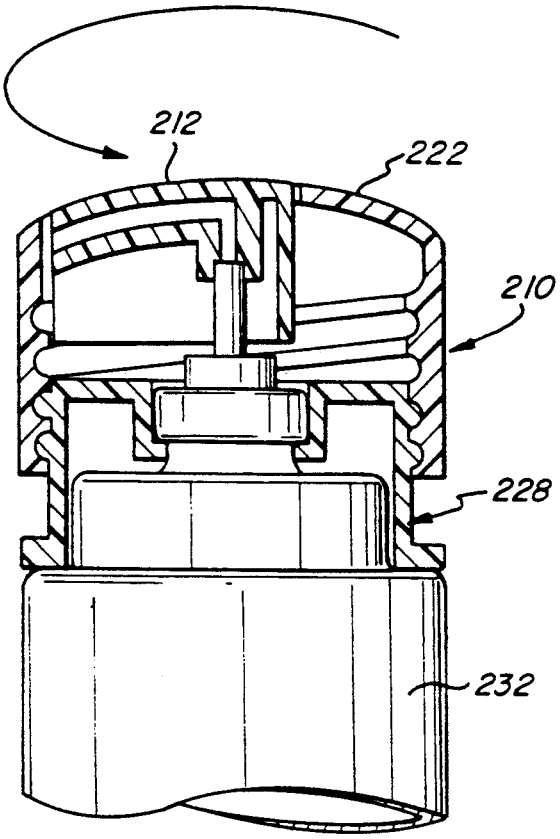
FIG. 12 is a cross-sectional view of another embodiment of an actuator of the present invention with its cap in a raised position covering the actuator.
Figure 14:
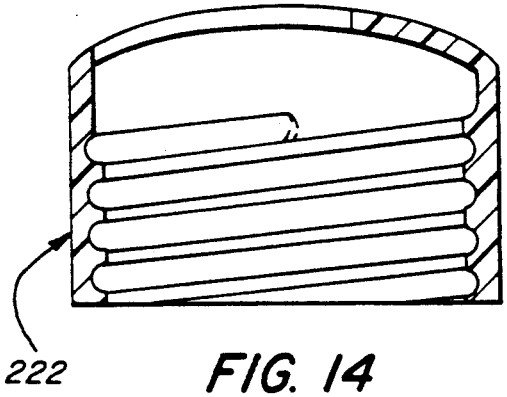
FIG. 14 is a cross-sectional view of the cap of the actuator of FIG. 7.
Figure 13:
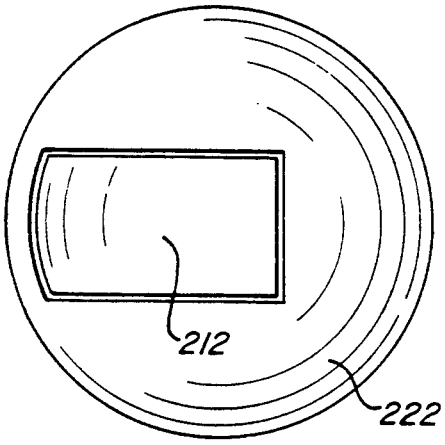
FIG. 13 is a top plan view of the actuator of FIG. 12.
Figure 15:
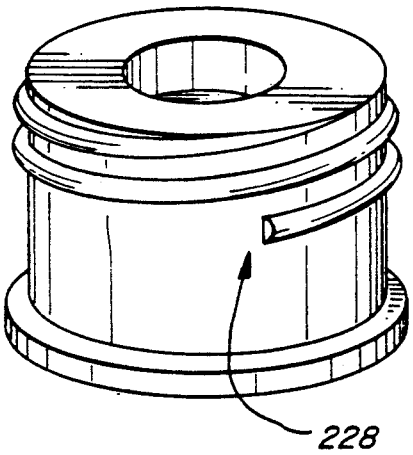
FIG. 15 is a perspective view of an upper collar segment of the actuator of FIG. 7.

With reference to FIGS. 12–15, where like numbers indicate like elements in the Figures, another embodiment of an actuator 210 is shown. Actuator 210 has an actuator body 212 and a cap 222. Actuator body 212 may be substantially as described in reference to actuator body 12 of the pump actuator 10. Cap 222 is movable on container 232 between a raised position as shown in FIG. 12 and a retracted position by screw rotation of the cap 222 downward. This is due to the engagement of a mating threading in cap 222 and on upper collar segment 228. Collar segment 228 can be a separate piece mounted on a container 232 or it can be integrally formed therewith. The threaded cap permits locking of the cap 222 in the raised position and in a retracted position.

It is to be appreciated that other embodiments may be devised within the scope of the invention to provide the unique combination of an actuator body enclosed with a retractable cap that is retained on a container. For example, the cap may be otherwise screw threaded to retract by threading rather than by simple vertical sliding. The actuator may have circular or triangular cross-sections instead of the rectangular cross-section of the substantially planar body 12 of the preferred embodiment. Other means for locking the cap in its raised or retracted positions may be provided.

It is to be appreciated that the foregoing is illustrative and not limiting of the invention, and that the practitioner may also develop other embodiments all within the scope of the invention.

We claim:

1. An actuator for dispensing liquids from a container, comprising:

a substantially planar, actuator body having a generally rectangular cross-section and a channel extending therethrough to a nozzle end;

an outer cap, said cap having an aperture sized to snugly receive said actuator body, and being slidably retained on the container, and slidably movable from a raised position to a retracted position, said cap in said raised position being located with said actuator body fitted in said aperture and said cap enclosing said nozzle end of said actuator body, said cap in said retracted position being located such that said actuator body extends upwardly from said cap without obstruction of said nozzle end.

2. An actuator in accordance with claim 1, wherein said cap and actuator body form a substantially flush upper surface when said cap is in said raised position.

3. An actuator in accordance with claim 2, wherein said substantially planar actuator body has an upper end comprising a curved surface, and said cap has a curved upper surface that is congruent with the curved surface of said upper end of said planar actuator body.

4. An actuator in accordance with claim 2, further comprising a notched cutaway below said nozzle end of said planar actuator body whereby said nozzle end is visibly distinct from said planar body.

5. An actuator in accordance with claim 2, wherein said container comprises a larger diameter lower segment and a smaller diameter upper segment, said upper segment being sized to telescopically fit inside and retain said cap to said container.

6. An actuator in accordance with claim 2, further comprising cap locking means to lock said cap in said retracted position.

7. An actuator in accordance with claim 6 wherein said container is provided with an upper collar segment having a track with a vertical track segment and a horizontal track segment, and said cap is provided with a track pin fittable in said track to guide said cap from said raised position to said retracted position, said horizontal track permitting locking of said cap in its raised position.

8. An actuator in accordance with claim 1, further comprising cap locking means to lock said cap in said raised position.

9. An actuator in accordance with claim 1, further comprising a reciprocating pump connected to said actuator, such that said actuator channel is operably connected to said pump.

10. An actuator in accordance with claim 9, wherein said reciprocating pump comprises:

a hollow body having upper and lower ends having openings therein;

a lower valve located in and adapted to close said opening in said lower end of said body during an increase in pressure inside said hollow body and to open said opening during a decrease in pressure inside said hollow body;

a hollow piston fitted into said upper end of said body and retained in and slidable reciprocally with sealing fit in said body, said piston having upper and lower ends having openings therein;

an upper valve fitted into the upper end of said piston, said upper valve being movable to vent said body during an increase in pressure inside said hollow body and being movable to close said body during a decrease in pressure inside said hollow body; and means for biasing said piston against downward movement.

11. An actuator in accordance with claim 10 further comprising a collar formed with said container for retaining said piston in said body, said body being retained against said collar by a retaining protruberance in said container.

12. An actuator for dispensing liquids from a container, comprising:

a substantially planar actuator body having a generally rectangular cross-section and a channel extending therethrough to a nozzle end along one lateral side thereof;

an outer cap slidingly retained on said container, said cap having an aperture sized to snugly receive said actuator body, and being slidably movable from a raised position to a retracted position, said cap in said raised position being located with said actuator body fitted in said aperture to form a substantially flush upper surface and to enclose said nozzle end in said cap, said cap in said retracted position being located such that said actuator body extends upwardly from said cap without obstruction of said nozzle end.

13. An actuator in accordance with claim 12, further comprising means for locking said cap in said raised position.

14. An actuator in accordance with claim 13, further comprising means for locking said cap in said retracted position.

15. An actuator in accordance with claim 14, wherein said cap is provided with a lower cap skirt and an upper cap segment, and said lower cap skirt is slidable on and retained on said container.

16. An actuator in accordance with claim 15, wherein said container comprises a larger diameter lower segment and a smaller diameter upper segment, said container upper segment being sized to telescopically fit inside said lower cap skirt and

17. An actuator in accordance with claim 15 wherein said container is provided with an upper collar segment having a track with a vertical track segment and a horizontal track segment, and said cap is provided with a track pin fittable in said track to guide said cap from said raised to said retracted position, said horizontal track permitting locking of said cap in its raised position.

18. An actuator for dispensing liquids from a container, comprising:

a substantially planar actuator body having a generally rectangular cross-section and a channel extending therethrough to a nozzle end along one lateral side thereof and having an upper end comprising a curved surface;

an outer cap slidingly retained on said container, said cap having a curved upper surface that is congruent with the curved surface of said upper end of said planar actuator body and having an aperture sized to snugly receive said actuator body, said cap having a lower cap skirt and an upper cap segment, said container having a larger diameter lower segment and a smaller diameter upper segment, said container upper segment being sized to telescopically fit inside said cap skirt and retain said cap to said container, said cap being slidably movable from a raised position to a retracted position, said cap in said raised position being located with said actuator body fitted in said aperture to form a substantially flush upper surface and to enclose said nozzle end in said cap, said cap in said retracted position being located such that said actuator body extends upwardly from said cap without obstruction of said nozzle end;

means for locking said cap in said raised position;

means for locking said cap in said retracted position; and a reciprocating pump connected to said actuator, such that said actuator channel is operably connected to said pump.

* * * * *